US005558297A

United States Patent [19]

Elmore

[11] Patent Number: 5,558,297

[45] Date of Patent: Sep. 24, 1996

[54] NECKERCHIEF ROLLING DEVICE

[76] Inventor: Donna B. Elmore, 101 Pecanwood Dr., Long Beach, Miss. 39560

[21] Appl. No.: 384,951

[22] Filed: Feb. 7, 1995

[51] Int. Cl.[6] ..... B65H 75/10

[52] U.S. Cl. ..... 242/532.6; 242/588; 242/609

[58] Field of Search ..... 242/532.6, 609, 242/609.1, 609.2, 609.3, 613.5, DIG. 3, 579, 588, 588.2

[56] References Cited

U.S. PATENT DOCUMENTS

| | | | |
|---|---|---|---|
| 761,751 | 6/1904 | Barrett | 242/609 |
| 802,189 | 10/1905 | Haskins | 242/609.2 |
| 1,270,188 | 6/1918 | Mochon | 242/532.6 |
| 1,353,948 | 9/1920 | Dutro et al. | 242/609 |
| 1,377,169 | 5/1921 | Maize | 242/588 |
| 1,410,014 | 3/1922 | Hurlburt | 242/609 |
| 1,612,256 | 12/1926 | Borroughs | 242/609 |
| 2,102,446 | 12/1937 | Wallace | 242/609 |
| 2,352,427 | 6/1944 | Gantt . | |
| 2,615,642 | 10/1952 | Schulz . | |
| 3,131,805 | 5/1964 | Gardner . | |
| 3,664,594 | 5/1972 | Novak . | |
| 5,181,670 | 1/1993 | Eaton et al. | 242/588 |

FOREIGN PATENT DOCUMENTS

| | | | |
|---|---|---|---|
| 485632 | 12/1954 | Italy | 242/609 |
| 562868 | 2/1959 | Italy | 242/609 |
| 404022 | 1/1934 | United Kingdom | 242/609 |

*Primary Examiner*—John P. Darling

*Attorney, Agent, or Firm*—Pravel, Hewitt, Kimball & Krieger

[57] ABSTRACT

A neckerchief rolling device includes first and second rods which are provided with co-acting fasteners for joining the interior ends thereof in end to end aligned relation. A neckerchief engagement adjacent the interior end of at least one of the rods engages a corner edge of a neckerchief for rolling the neckerchief onto the rod in response to rolling movement of the rod across the neckerchief. The co-acting fasteners are releasable, enabling axial withdrawal of the first and second rods from opposite ends from the rolled up neckerchiefs.

12 Claims, 3 Drawing Sheets

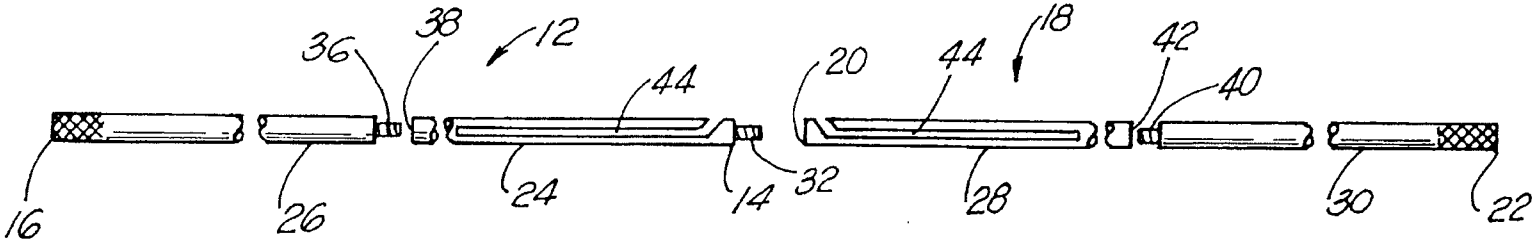
FIG. 3
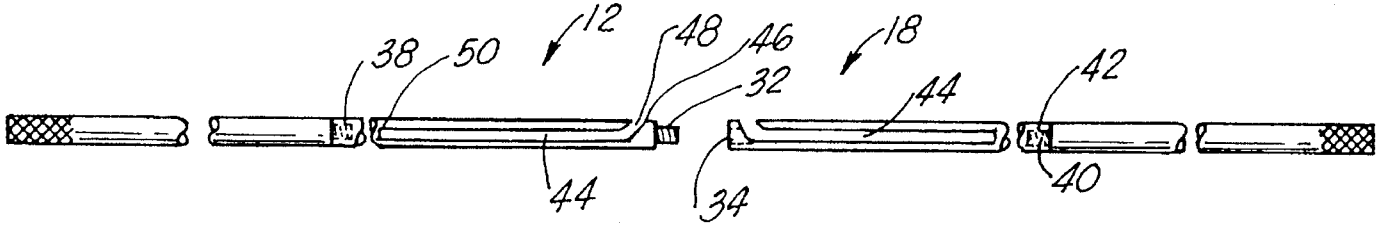
FIG. 5
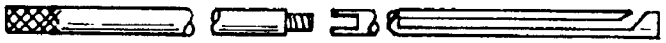
FIG. 7
FIG. 4
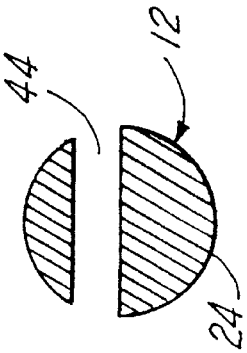
FIG. 6

NECKERCHIEF ROLLING DEVICE

BACKGROUND OF THE INVENTION

The present Invention is directed generally to a tool for neatly and accurately rolling flat fabric into a roll and more particularly to a tool for facilitating the rolling of a neckerchief of the type worn by naval personnel to meet strict uniform specifications.

The rolling device of the present Invention is for rolling a square or rectangular piece of fabric such that the axis of the resulting roll is diagonal to side edges of the neckerchief. This occurs, for example, when rolling starts at one of the corners.

This tool is particularly useful to naval personnel who are required, as part of their dress uniform, to roll a large square neckerchief from two opposing corners diagonally toward the center. Since the ordinary neckerchief is generally made of silk or another light fabric, so that the overall thickness of the rolled neckerchief is as uniform a thickness as possible, it is easily distorted and is frequently not a true square. Accordingly, achieving the perfect roll required for inspection is time consuming and difficult.

Numerous attempts have been made to perform this task with greater efficiency, commonly by utilizing a coin, a pencil, or some other object to start the roll. That object, however, has to be left in the rolled neckerchief since the neat uniform appearance of the roll would generally be disturbed by attempts to remove the object from the roll. The use of such starter objects does not assure any uniformity of the roll but simply assists in starting the process.

Accordingly, a primary object of the Invention is to provide an improved fabric rolling device.

Another object is to provide such a device for uniformly and symmetrically rolling a neckerchief.

Another object is to provide a neckerchief rolling device which is engageable with a corner of a neckerchief to facilitate starting the roll, yet which is easily withdrawing from the completed roll.

Another object of the invention is to provide a neckerchief rolling device which will uniformly roll a neckerchief made from a very thin fabric.

Another object is to provide a neckerchief rolling device which is at least as long as the longest dimension of a rolled neckerchief thereby to assure a uniform diameter of the neckerchief throughout the length of the roll.

Another object is to provide a neckerchief rolling device which can be easily used by one person.

Another object is to provide a neckerchief rolling device which enables even a beginner to precisely and symmetrically roll a neckerchief on the initial attempt.

Finally, an object is to provide a neckerchief rolling device which is simple and rugged in construction, economical to manufacture and efficient in operation.

SUMMARY OF THE INVENTION

The neckerchief rolling device of the present Invention includes first and second rods which are provided with co-acting fasteners for joining the interior ends thereof in end to end aligned relation. A neckerchief engagement means adjacent the interior end of at least one of the rods engages a corner edge of a neckerchief for rolling the neckerchief onto the rod in response to rolling movement of the rod across the neckerchief. The co-acting fasteners are releasable, enabling axial withdrawal of the first and second rods from opposite ends from the rolled up neckerchiefs.

A preferred neckerchief engagement means is a slot extended axially through the rod and having an open end, adjacent the interior end of the rod, and an opposite closed end, the slot being open, extending between opposite sides of the rod to enable passage of a corner edge portion of the neckerchief into the slot. The slot is cut within the rod so that the exterior of the rod is of a uniform diameter throughout its entire length, preventing bunching or wrinkling of the rolled neckerchief. The open end of the slot opens through the side of the rod at a position adjacent the interior end of the rod. Preferably a similar slot is formed in each of the first and second rods with the open ends of the slots being disposed in close adjacent relation upon joining of the rods together.

The co-acting fasteners for joining the rods together may include a stud extending generally axially from the interior end of the first rod and a stud receiving socket extending generally into the interior end of the second rod for receiving the stud in press fit relation therein. It is desirable that the studs are shaped so that the rods fit together in one alignment, with the open slots facing each other in opposed juxtaposition.

Each rod preferably includes separable interior and exterior rod portions for compact storage of the separate rod portion when the device is not in use. The exterior ends of the first and second rods may be knurled to facilitate manual rolling of the rod across a neckerchief.

The Invention further contemplates an improved method for symmetrically and uniformly rolling a generally square fabric or neckerchief up to a diagonal line. The method includes the step of joining the first and second rods together, selecting a first corner of the fabric from which to begin rolling, marking one edge, adjacent the selected corner of the fabric a finite distance from the first corner, measuring the distance from that mark to the selected corner, marking the other edge forming the selected corner at a position spaced from the selected corner by the above measured distance, aligning the joined rods with both marks, engaging the fabric adjacent the first corner in the fabric engagement means of the rods, rolling the joined rods to roll the fabric onto the rods, up to the diagonal line, and then withdrawing the rods from within the rolled fabric. The roll is temporarily held in position by any convenient weight, until rolling is finished and the neckerchief is tied, The rolling step may be terminated at the widest portion of the fabric in the direction of the rods and repeated from the corner opposite the first corner, rolling toward the previously rolled fabric half. In this case the first roll is held by a weight until the rods are engaged with the fabric at the opposite corner, and the second roll is completed. Alternatively, the fabric may first be folded along the diagonal line to form a double thickness triangular fabric shape. The fabric is then rolled towards the triangular base, which is the diagonal line of the fabric when unfolded to a square. The process set forth above is followed, differing only in that both thicknesses of fabric are engaged in the fabric engagement means of the rods at the marks, and only a single rolling step is required.

BRIEF DESCRIPTION OF THE FIGURES

FIG. 3 is a foreshortened exploded side elevational view of the neckerchief rolling device.

FIG. 4 is a foreshortened side elevational view of the first rod of the device.

FIG. 5 is a foreshortensd side elevational view of the second rod of the device.

FIG. 6 is an enlarged sectional view taken along line 6—6 in FIG. 5.

FIG. 7 is a side sectional view showing the co-acting engagement means between the first and second rods.

DETAILED DESCRIPTION OF THE INVENTION

Figure 1:
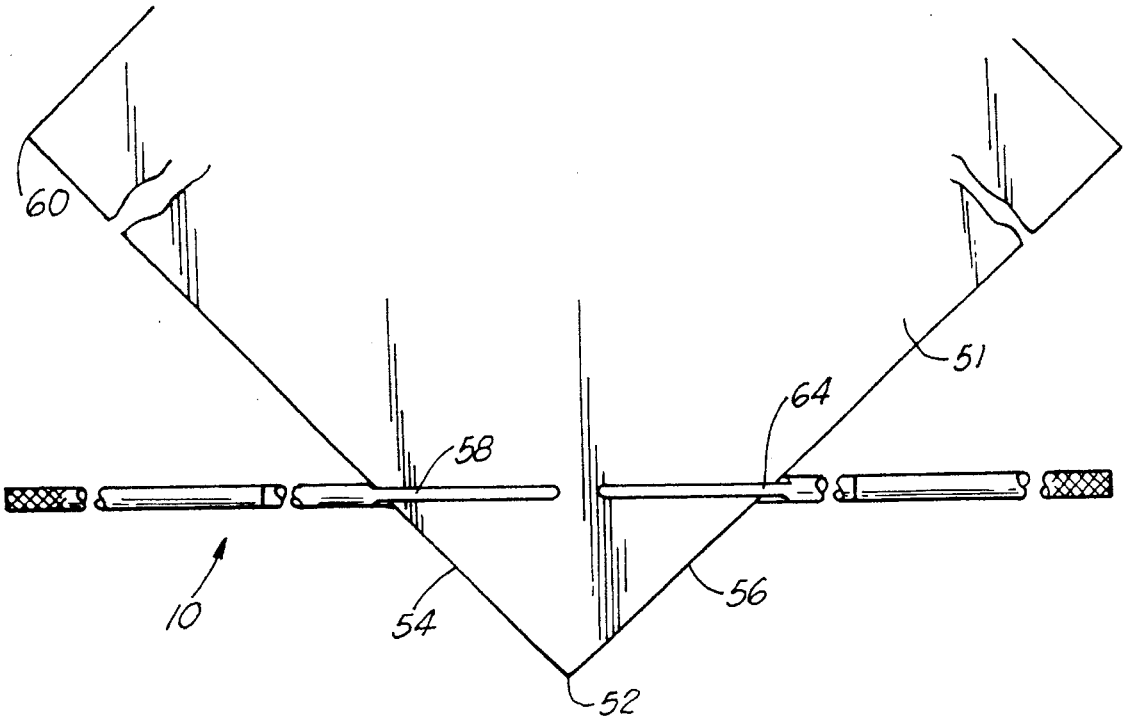
FIG. 1 is a foreshortened top plan view showing the neckerchief rolling device engaging one corner of a neckerchief to be rolled.
Figure 2:
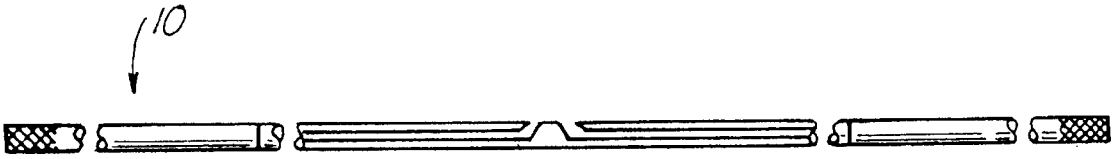
FIG. 2 is a foreshortened side elevational view of the neckerchief rolling device.
Figure 8:
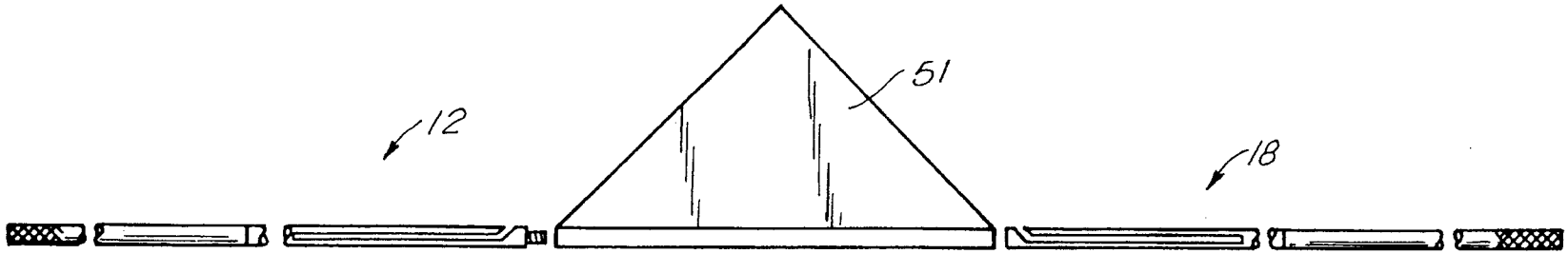
FIG. 8 is a top plan view showing the first and second rods being withdrawn from the rolled half of the neckerchief.
Figure 9:
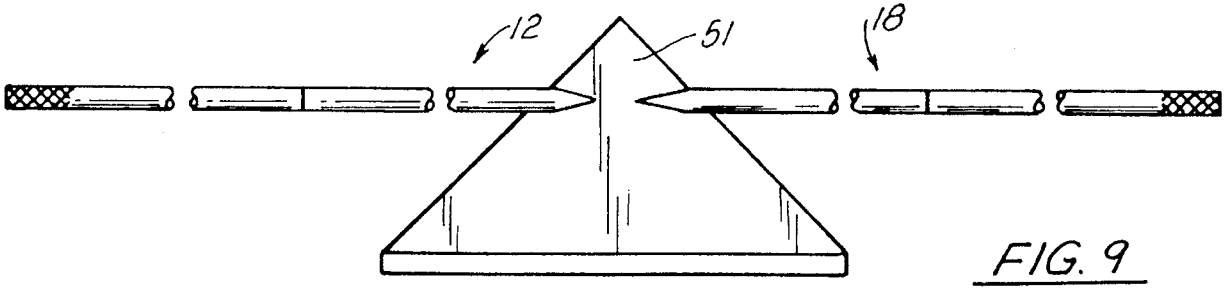
FIG. 9 is a foreshortened top plan view of the assembled neckerchief roller in place for rolling the second half of a neckerchief.
Figure 10:
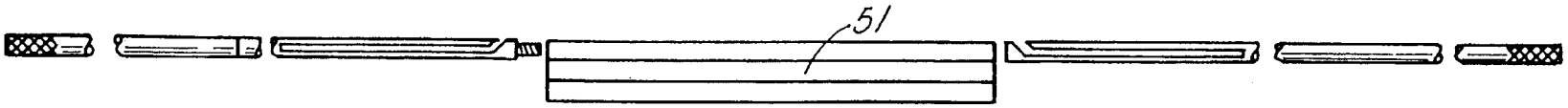
FIG. 10 is a top plan view showing the first and second rods withdrawn from the rolled second half of the neckerchief.

The neckerchief rolling device 10 of the present Invention is illustrated in the drawings as including a first rod 12 having interior and exterior ends 14 and 16 and a second rod 18 having interior and exterior ends 20 and 22. First rod 12 can furthermore be separated into interior and exterior rod portions 24 and 26 and second rod 18 may likewise be separated into interior and exterior portions 28 and 30.

This enables the device to be broken down into a much shorter structure for compact storage.

In a preferred embodiment of the Invention for rolling the neckerchiefs of naval personnel, the overall length of the fully assembled device 10 is 60 inches. Whereas such a long thin rod would be cumbersome and inconvenient to store and transport, the bundle of 4 approximately 15 inches rod portions can be conveniently stored in a drawer, briefcase, or the like.

FIG. 3 illustrates the co-acting fastening means for joining the interior ends 14 and 20 of first and second rods 12 and 18 in end to end aligned relation. That co-acting fastening means includes a stud 32 which extends generally axially from the interior end 14 of first rod 12 for insertion within a stud receiving socket 34 which extends generally axially into the interior end 20 of second rod 18. It is preferred that stud 32 be frictionally press-fit within socket 34 so that the first and second rods 12 and 18 tend to remain joined and to roll in unison, yet being readily pulled apart by an operator having finger grip access to the exterior ends 16 and 22 of the first and second rods 12 and 18. Alternately, stud 32 may be keyed to socket 34 to retain first rod 12 and second rod 18 in rotational alignment so that slots 44 are aligned in opposed juxtaposition.

Similarly, a co-acting securement means is provided for releasably securing together the rod portions of each of the first and second rods 12 and 18. As shown best in FIGS. 3 and 7, the co-acting securement means includes a threaded stud 36 on the interior end of exterior rod portion 26 and a threaded socket 38 on the exterior end of interior rod portion 24. The stud 36 and socket 38 are aligned with the center line of the rod portions and with one another for threaded securement of the interior and exterior rod portions 24 and 26 to form the single first rod 12. Likewise, a similar threaded stud 40 and threaded socket 42 are formed on the adjoining ends of exterior rod portion 30 and interior rod portion 28 of second rod 18.

Within each of first rod 12 and second rod 18 are provided interior slots 44. Interior slot 44 has an open end 48 adjacent the interior ends 14, 20 of their respective rods 12, 18, and formed with pointed inner ends 46 adjacent their respective inner ends 14, 20. Slots 44 extend inwardly along each of interior rods 24, 28 to an opposite end 50; slots 44 run substantially parallel to the sides of the interior rods 24, 28. As shown in FIG. 6, for first rod 12, the formation of slot 44 is such that the outer diameter of interior rod 24 is uniform throughout, and no protuberances or bumps exist on the surface of first rod 12 or second rod 18 throughout their length. Thus when first rod 12 and second rod 18 are joined together, the overall invention 10 has a uniform outer diameter.

In use a neckerchief 51 having a substantially square shape, formed of a thin, limp fabric, such as silk or a similar synthetic fabric, is to be rolled into a smooth shape. The fabric is so limp, and so slick that merely attempting to roll the square up from one corner results in bunching of the fabric, as there is no support around which a tight roll can be formed. The invention 10 is formed by assembling the First and second rods 12, 18 joining together the co-acting stub 32 and socket 34 so that the slots 4 are aligned, with their open ends 48 in opposed juxtaposition, with minimum distance between the ends 48.

The neckerchief 51 is to be rolled up along a diagonal 60; it is therefore necessary to start from a corner 52 of the neckerchief 51, where adjacent side edges 54, 56 meet. The corner 52 of the neckerchief 51 is slid into the opposed slots 44 until the adjacent sides 54, 56 slide into their respective opposed slots 44 a distance until side 54 and side 56 are uniformly centered into the slots 44. It is desirable to mark the neckerchief 51 with measured lines on the adjacent edges 54, 56 to denote the position from which the roll should commence for even rolling. A first line 58 is marked on first edge 58 a measured distance from corner 52. The same distance is then measured from corner 52 along adjacent side 56 to a second mark 64 placed at that distance.

Then the neckerchief 51 is slid into the slots 44 until first mark 58 on first side 54 and second mark 64 on side 56 are lined up with their respective slot 44. The invention 10 is then turned or rolled by hand until one half of the neckerchief 51 is rolled up to the diagonal 60. Since the assembled invention 10 is of a uniform outer diameter, knurled ends are provided on the outer ends of the outer rods 26, 28, to provide a more easily rolled surface for finger movement. Typically best results are achieved when the rod and fabric neckerchief are laid on a smooth flat level surface and the rod rolled to the diagonal by finger movement of the outer ends of the rods. This prevents slipping or sliding of the rods which would bunch up the fabric.

Figure 11:
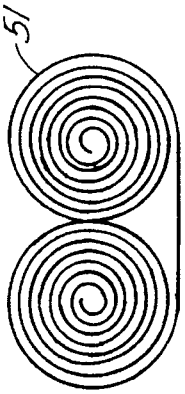
FIG. 11 is an enlarged end view of the rolled neckerchief.

The invention 10 is then removed form the roll by gentle pulling apart of first rod 12 and second rod 18, sliding the neckerchief out of the slots 44. The process is then repeated form the opposite corner 52, resulting in the desired double roll as shown in FIG. 11.

It is important that the openings 46 of the slots 44 be closely and opposingly juxtaposed when the, first rod 12 is joined to the second rod 18, and that the slotted interior rods 24, 28 be of uniform diameter throughout. Otherwise the neckerchief will bunch up and wrinkle in the middle, or the thickness of the roll will not be uniform throughout its length; neither condition is acceptable.

It can thus be seen that the invention is capable of providing an easier means for rolling a uniform neckerchief, without bunching or wrinkling of the fine limp fabric involved, and of easy application to perform the opposed double roll desired.

I claim:

1. A neckerchief rolling device for symmetrically and uniformly rolling a neckerchief, comprising:

first and second rods, each having opposite interior and exterior ends;

co-acting fastening means on said first and second rods for joining the interior ends thereof in end to end aligned relation;

neckerchief engagement means adjacent the interior end of at least said first rod, wherein said neckerchief engagement means comprises a slot extended axially through said first rod and having an open end adjacent the interior end of said first rod and having an opposite closed end; said slot being open through opposite sides of the rod to enable passage of a portion of the neckerchief therethrough, whereby, upon engagement of a neckerchief by said engagement means and rolling said joined rods across the neckerchief, the neckerchief is rolled onto the joined rods;

said neckerchief engagement means positioned interior to said first rod, such that said first rod is of uniform external diameter throughout its length; and said co-acting fastening means being releasable to enable axial withdrawal of said first and said second rods from opposite ends of a rolled up neckerchief.

2. The neckerchief rolling device of claim 1 wherein each of said first and second rods have said neckerchief engaging slot.

3. The neckerchief rolling device of claim 1 wherein the open end of said slot opens through a side of said first rod adjacent the interior end thereof.

4. The neckerchief rolling device of claim 1, wherein said co-acting fastening means comprises a stud extending generally axially from the interior end of said first rod and a stud receiving socket extending generally into the interior end of said second rod and adapted to receive said stud.

5. The neckerchief rolling device of claim 4 wherein said socket is adapted to receive said stud in press-fit relation therein.

6. The neckerchief rolling device of claim 1, wherein each of said first and second rods comprises interior and exterior rod portions and co-acting securement means on adjacent ends of said rod portions for securing said rod portions together in end to end aligned relation, said securement means being disengaged for compact storage of the separate rod portions.

7. The neckerchief rolling device of claim 6 wherein said co-acting securement means comprises a threaded stud extending generally axially from one of said rod portions and a threaded socket in the end of the other rod portion of each rod.

8. The neckerchief rolling device of claim 6, further comprising means for rotating said exterior rod portions.

9. The neckerchief rolling device of claim 8, wherein said means for rotating said exterior rod portions comprises knurling on the side surface of each exterior rod portion adjacent the exterior end thereof.

10. A method of symmetrically and uniformly rolling a generally square piece of fabric, comprising:

providing a fabric rolling device including first and second rods having co-acting fastening means for joining interior ends of the rods and forming thereby a single rod having a uniform external diameter;

joined in end to end aligned relation, and fabric engagement means adjacent the interior end of at least one of said rods;

joining the first and second rods together with said co-acting fastening means;

selecting a first corner of said fabric from which to begin rolling;

marking one edge of the fabric a final distance from same first corner;

measuring the distance from said mark to the fabric corner at the opposite end of said one edge;

marking the other edge forming said first corner at a position spaced from the opposite end thereof by said above measured distance;

placing said joined rods on said fabric in aligned relation with said marks;

engaging said first corner in said fabric engagement means;

rolling said joined rods to roll said fabric onto the rods; and withdrawing said rods from opposite ends of the rolled fabric.

11. The method of claim 10 wherein said rolling step is terminated generally at the widest portion of said fabric in the direction of said rods, whereupon said joining, selecting, marking, measuring, marking placing, engaging and rolling steps are repeated from the corner opposite said first corner, with prior references to said first corner referring to said opposite corner.

12. The method of claim 11 wherein said fabric engagement means comprises inserting said first corner through a slot.

* * * * *